United States Patent [19]

Deininger

[11] 4,435,256

[45] Mar. 6, 1984

[54] PROCESS FOR MAKING POTASSIUM FERRATE (FE(VI)) BY THE ELECTROCHEMICAL FORMATION OF SODIUM FERRATE

[75] Inventor: J. Paul Deininger, Cleveland, Tenn.

[73] Assignee: Olin Corporation, New Haven, Conn.

[21] Appl. No.: 510,115

[22] Filed: Jul. 1, 1983

Related U.S. Application Data

[63] Continuation-in-part of Ser. No. 246,790, Mar. 23, 1981, and a continuation-in-part of Ser. No. 246,794, Mar. 23, 1981.

[51] Int. Cl.[3] ..... C25B 1/00

[52] U.S. Cl. ..... 204/86; 204/283

[58] Field of Search ..... 204/86

[56] References Cited

U.S. PATENT DOCUMENTS

| | | | |
|---|---|---|---|
| 669,441 | 3/1901 | Frasch | 204/113 |
| 2,275,223 | 3/1942 | Hardoen | 204/56 |
| 2,455,696 | 12/1948 | Mosesman | 252/231.5 |
| 2,758,090 | 8/1956 | Mills et al. | 252/186 |
| 2,835,553 | 5/1958 | Harrison et al. | 23/50 |
| 2,967,807 | 1/1961 | Osborne et al. | 204/98 |
| 3,632,802 | 1/1972 | De Miller et al. | 260/233.3 R |
| 3,904,496 | 9/1975 | Harke et al. | 204/98 |
| 4,036,714 | 7/1977 | Spitzer | 204/98 |
| 4,201,637 | 5/1980 | Peterson | 204/197 |

OTHER PUBLICATIONS

J. Tousek, "Electrochemical Production of Sodium Fenate", *Collection Czechoslov Chem. Commun.*, vol. 27, pp. 914, 919 (1962).

Miller, "The Preparation, Determination, and Analytical Applications of Iron (VI)", *Analytical Chemistry*, p. 3343 B.

Mellor, "A Comprehensive Treative on Inorganic & Theoretical Chemistry", vol. XII, pp. 929–937, (1952).

Grube et al., *Zeitschrift Fur Electrochemie*, vol. 26, No. 7/8, 21/22 pp. 153–161, 459–471, (1920).

Chemical Abstracts 65:16467, 1966.

Helferick et al., Z. Anorg. Allg. Chemie, 263, pp. 169–174, 1956.

Pick, *Zeitschrift Fur Electrochemie*, 7, pp. 713–724, 1901.

Scholder et al., Z. Anorg. Allg. Chemie, vol. 282, pp. 262–279, 1955.

Andett. et al., *Inorganic Chemistry*, vol. 11, No. 8, pp. 1904–1908, (1972).

J. M. Schreyer, "Higher Valence Compounds of Iron", Doctoral Thesis at Oregon State College, Jun. 1948.

Chemical Abstracts 86:78488K, 1977.

Chemical Abstracts 89:135578c, 1978.

Kirk-Othmer Encyclopedia of Chemical Technology, 2 Edition, vol. 12, p. 40, 1967.

Goff et al., J. *of the American Chemical Society*, vol. 93:23, pp. 6058–6065, No. 17, 1971.

*Primary Examiner*—T. Tung

*Attorney, Agent, or Firm*—Arthur E. Oaks; Donald F. Clements

[57] ABSTRACT

Described is a process for making potassium ferrate by the formation of sodium ferrate in a membrane-type electrolysis cell. The anolyte chamber of the cell is charged with an aqueous solution of sodium hydroxide and a sodium ferrate-stabilizing proportion of at least one sodium halide salt. The anolyte chamber additionally contains ferric ions [Fe(III)]. The catholyte chamber contains an aqueous sodium hydroxide solution. The source of ferric ion in the anolyte may be either an iron-containing anode or at least one iron-containing compound present in the anolyte solution or both. The preferred membrane material for separating the anolyte chamber from the catholyte chamber is comprised of a gas- and hydraulic-impermeable, ionically-conductive, chemically-stable ionomeric film (e.g., a cation-exchange membrane) with carboxylic, sulfonic or other inorganic exchange sites. Sodium ferrate is prepared in the anolyte chamber by passing an electric current and impressing a voltage between the anode and cathode of the cell. During electrolysis, sodium ferrate forms in the aqueous sodium hydroxide anolyte. This anolyte is reacted with a potassium compound to product potassium ferrate [Fe(VI)]. Alternatively, the sodium ferrate may be first recovered in a solid form and then reacted with a potassium compound to produce potassium ferrate.

28 Claims, No Drawings

PROCESS FOR MAKING POTASSIUM FERRATE [FE(VI)] BY THE ELECTROCHEMICAL FORMATION OF SODIUM FERRATE

This application is a continuation-in-part of application Ser. No. 246,790, filed Mar. 23, 1981. This application is also a continuation-in-part of application Ser. No. 246,794, filed Mar. 23, 1981.

BACKGROUND OF THE INVENTION

1. Field of the Invention

The present invention relates to the production of potassium ferrate by an electrolytic process for forming sodium ferrate in a membrane-type electrolysis cell.

2. Description of the Prior Art

Alkali metal and alkaline earth metal ferrates resemble permanganate in having a purple color and, in acid solutions, they evolve oxygen very rapidly.

The prior art teaches two principal methods for making alkali metal and alkaline earth metal ferrates. One method of preparation has been by electrolysis either in unseparated cells or in diaphragm-type electrolytic cells (i.e., multi-chamber cells which have an anolyte separated from the catholyte by a gas-porous, hydraulically permeable separator).

Alkali metal and alkaline earth metal ferrates have also been produced by the reaction of inorganic hypochlorites with iron-containing compounds in aqueous alkaline solutions.

However, sodium ferrate produced by such prior art methods becomes unstable and tends to degrade almost immediately. This lask of stability is due to the hydrolysis of sodium ferrate with water in the cell or the atmosphere to form ferric hydroxide. Also, the prior art methods for making sodium ferrate by electrochemical means also have the problem of anode passivity, which is caused by the formation of ferric oxide film on the iron anode. Further, once formed, this film has been found to catalyze and thus speed up the rate of ferrate decomposition. To prevent such problems, it is necessary to either wash the anode with acid or reverse the current to remove such a ferric oxide film. However, these techniques are costly or time-consuming, or both.

The strong oxidizing properties of ferrates suggest that they may be useful for a variety of commercial uses (e.g., oxidation of chemical moieties in waste water streams). However, the aforesaid instability tends to severely limit such utility for commercial applications. Thus, there is a need at the present time to find a commercial process for producing ferrates.

OBJECTS

It is a primary object of this invention to provide an improved electrolytic process for preparing at stable potassium ferrate.

Another object of this invention is to provide an improved process for conversion of a sodium ferrate solution resulting from electrolysis to potassium ferrate.

These and other objects of the present invention will become apparent from the following description and the appended claims.

BRIEF SUMMARY OF THE INVENTION

The present invention, therefore, is directed to a process for the production of potassium ferrate, utilizing an electrolytic cell having an anolyte chamber containing an anode, a catholyte chamber containing a cathode, and a gas and liquid impermeable membrane between the chambers, the process comprising the steps of:

(a) admixing sodium hydroxide containing less than about 0.02% by weight of sodium halide with sufficient sodium halide to increase the sodium halide concentration of the resulting mixture to between about 0.02% and about 4.0% by weight;

(b) electrolyzing said resulting mixture while in contact with ferric ions as the anolyte of an electrolysis process whereby sodium ferrate is formed in the anolyte;

(c) reacting said sodium ferrate with a potassium compound capable of reacting with said anolyte to form a potassium ferrate precipitate; and (d) recovering said potassium ferrate therefrom.

DETAILED DESCRIPTION

1. GENERAL CELL CONSTRUCTION

Electrolytic cells employed in this invention may be a commercially available or a custom built membrane-type electrolytic cell of a size and electrical capacity capable of economically producing the desired sodium ferrate product. Since the electrolytic cell contains a strong base throughout, it should be constructed of any material resistant to strong bases and strong oxidant chemicals. It may be desirable to line the inside surfaces of the cell with a plastic material resistant to NaOH solutions and sodium ferrate or the cell may be constructed entirely of plastic material.

A particularly advantageous membrane-type electrolytic cell which may be employed in the practice of this process has separate anolyte and catholyte chambers, using a permselective cation exchange membrane as a separator. Located on one side of the membrane partition, the anolyte chamber has an outlet for any oxygen gas generated, and an inlet and an outlet for charging, removing or circulating anolyte. On the opposite side of the membrane partition, the catholyte chamber has inlets and outlets for the sodium hydroxide solution and an outlet for hydrogen liberated at the cathode by the electrolysis of water.

Electrolytic cells employed in the present invention may be operated on a batch or flow-through system. In the latter system, either anolyte or catholyte, or both, may be continuously circulated to and from external solution storage vessels.

Hydrogen gas is removed from the catholyte chamber and collected for use as a fuel or otherwise disposed of. Any oxygen gas evolved is likewise removed from the anolyte chamber.

2. MEMBRANE CONSTRUCTION

Membrane material employed as a separator between the anolyte and catholyte chambers should be physically and chemically stable both to strong sodium hydroxide solutions and to strong oxidizing chemicals (e.g., sodium ferrate) before, during, and after cell operation. The membrane should also be ionically conductive and allow ion flow between the two chambers. However, the ionic transport of ferrate ion [$FeO_4^{-2}$] should be much lower than that of the sodium ion [$Na^+$], hydroxide ion [$OH^-$] and hydrogen ion [$H^+$].

For the purposes of this invention, suitable membrane materials are gas- and hydaulic-impermeable permselective cation-exchange materials including sulfonic acid substituted perfluorocarbon polymers of the type described in U.S. Pat. No. 4,036,714, which issued on July 19, 1977 to Robert Spitzer; primary amine substituted polymers such as those described in U.S. Pat. No. 4,085,071, which issued on Apr. 18, 1978 to Paul Raphael Resnick et al; polyamine substituted polymers of the type described in U.S Pat. No. 4,030,988, which issued on June 21, 1977 to Walter Gustav Grot; and carboxylic acid substituted polymers such as those described in U.S. Pat. No. 4,065,366, which issued on Dec. 27, 1977 to Yoshio Oda et al. All of the teachings of these patents are incorporated herein in their entirety by reference.

With respect to the sulfonic acid substituted polymers of U.S. Pat. No. 4,036,714, these membranes are preferably prepared by copolymerizing a vinyl ether having the formula $FSO_2CF_2CF_2OCF(CF_3)CF_2OCF=CF_2$ and tetrafluoroethylene followed by converting the $FSO_2$— group to a moiety selected from the group consisting of $HSO_3^-$, alkali metal sulfonate, and mixtures thereof. The equivalent weight of the preferred copolymers range from 950 to 1350 where equivalent weight is defined as the average molecular weight per sulfonyl group.

With reference to the primary amine substituted polymers of U.S. Pat. No. 4,085,071, the basic sulfonyl fluoride polymer of the U.S. Pat. No. 4,036,714 above is first prepared and then reacted with a suitable primary amine wherein the pendant sulfonyl fluoride groups react to form N-monosubstituted sulfonamido groups or salts thereof. In preparing the polymer precursor, the preferred copolymers utilized in the film are fluoropolymers or polyfluorocarbons although others can be utilized as long as there is a fluorine atom attached to the carbon atom which is attached to the sulfonyl group of the polymer. The most preferred copolymer is a copolymer of tetrafluoroethylene and perfluoro(3,6-dioxa-4-methyl-7-octenesulfonyl fluoride) which comprises 10 to 60 percent, preferably 25 to 50 percent by weight of the latter. The sulfonyl groups are then converted to N-mono-substituted sulfonamido groups or salt thereof through the reaction of a primary amine.

Polymers similar to the above U.S. Pat. No. 4,085,071 are prepared as described in U.S. Pat. No. 4,030,988 wherein the backbone sulfonated fluoride polymers are reacted with a di- or polyamine, with heat treatment of the converted polymer to form diamino and polyamino substituents on the sulfonyl fluoride sites of the copolymer.

The carboxylic acid substituted polymers of U.S. Pat. No. 4,065,366 are prepared by reacting a fluorinated olefin with a comonomer having a carboxylic acid group or a functional group which can be converted to a carboxylic acid group. It is preferred to use a fluorinated copolymer having a molecular weight to give the volumetric melt flow rate of 100 millimeters per second at a temperature of 250° C. to 300° C. Preferably, the membrane is prepared by copolymerizing tetrafluoroethylene with $CF_2=CFO(CF_2)_3COOCH_3$. Such polymers are believed to prevent substantial diffusion of the divalent ferrate ion [$FeO_4^{-2}$] through them. Also, such membranes are generally water-saturated, and when coupled with a low membrane thickness, will produce very low voltages across the membrane.

The thickness of the membrane may be in the range from about 1 to about 20 mils, and preferably from about 2 to about 5 mils. For selected membranes, a laminated inert cloth supporting material for the membrane of polytetrafluoroethylene may be used.

3. ANODE CONSTRUCTION

At least one electrode is positioned within the anolyte chamber and one electrode within the catholyte chamber. For maximum exposure of the electrolytic surface, the face of each electrode should preferably be parallel to the plane of the membrane.

The anode may be made of any conventional iron-containing anode material or, if the ferric ion source in the anolyte is different than the anode, may be of any conventional non-iron anode material. While the anode configuration is not critical, it should be shaped such as to give minimal electrolyte resistance drop and the most uniform current and potential distribution across its surface. This is usually a flat-plate, expanded mesh, particulate or porous electrode structure. High surface area anodes such as steel or iron wool are preferred because they will achieve a higher cell efficiency than plate anodes under the same operating conditions.

Preferred for said iron-containing anode material is pure iron since this tends to minimize the occurrence of heavy metal impurities known to adversely affect the stability of sodium ferrate. Other types of iron-containing materials that may be used to form an anode include cast iron, wrought iron and scrap iron materials with those highest in iron content such as cast iron and low-grade carbon steels being preferred.

Examples of non-iron materials which may be employed as the anode include commercially available platinized titanium, platinized tantalum, or platinized platinum electrodes, a deposit of platinum on titanium, platinum on tantalum, or platinum on platinum. Also, effective are anodes composed of graphite, lead dioxide, lead dioxide-coated carbon or metal substrates and the like. One skilled in the art will recognize, however, that any anode construction capable of effecting electrolytic production of sodium ferrate by the oxidation of iron species present in the anolyte to the Fe(VI) moiety (i.e., $FeO_4^{-2}$) while in an aqueous sodium hydroxide solution containing at least one sodium halide compound may be used in the process of this invention.

4. CATHODE CONSTRUCTION

Examples of materials which may be employed as the cathode are carbon steel, stainless steel, nickel, nickel-molybdenum alloys, nickel-vanadium alloys and others. Those skilled in the art will also recognize that any electronically-conducting material or substrate that is capable of effecting the electrolytic reduction of water to hydroxide with either high or low hydrogen overvoltage may be used as cathode construction material in the process of this invention.

5. ANOLYTE PARAMETERS

The anolyte is comprised of an aqueous solution of sodium hydroxide having at least a sodium ferrate-stabilizing amount of at least one sodium halide salt. The anolyte also contains ferric ions which are produced either from the iron anode or ferric salts, or both. The sodium halide salt or salts is necessary to increase the rate of corrosion of iron surfaces in the anolyte solution by permeating and weakening the oxide gel which forms thereon, thus aiding in the formation of ferric ions [Fe(III)] for conversion to ferrate ions [$FeO_4^{-2}$]. Further, it has been found that when the chloride content is kept above about 0.02% by weight in the sodium hydroxide dissolved in the anolyte, the rate of degradation of the resultant sodium ferrate formed is much lower than is the case when such a level of chloride is not used.

The sodium hydroxide concentrations maintained in the anolyte may range from about 20% to about 65% by weight of the aqueous solution in the anolyte. Preferably, NaOH concentrations in the range from about 40% to about 65% by weight of the aqueous solution are maintained. For the best efficiencies, the most preferred sodium hydroxide concentration is from about 50% to about 65% by weight of the aqueous solution. Generally, a suitable sodium hydroxide solution is charged into the anolyte chamber before electrolysis in order to maintain the above ranges of concentration throughout the operation.

The preferred sodium halide salts that may be added to the anolyte are sodium chloride, sodium hypochlorite, sodium bromide, sodium hypobromite and mixtures thereof. Alternatively, such sodium halide or hypohalite salts may be made in situ by the addition of $Cl_2$ or $Br_2$ to the sodium hydroxide anolyte solution, thus forming NaCl, NaOCl, NaBr or NaOBr. Fluoride and iodide salts may also be used, but are believed to be less desirable from a cost standpoint. The most preferred sodium halide salt is NaCl.

Any proportion of sodium halide salt or salts capable of effecting stabilization of sodium ferrate without adversely diluting the sodium ferrate product may be employed. The weight ratio of sodium hydroxide to sodium halide salt ranges from about 25:1 to about 5,000:1 and preferably from about 50:1 to about 1,000:1. Expressed another way, the halide ranges are from about 0.02% to about 4.0% and preferably from about 0.1% to about 2.0% by weight of the total weight of halide/hydroxide mixture used in the anolyte solution.

When employing sodium chloride as the sodium halide salt, its concentration in the anolyte is preferably maintained in the range from about 100 parts to about 15,000 parts per million parts by weight of the anolyte. More preferably, its concentration is from about 500 parts to about 10,000 parts per million parts by weight of the anolyte. Equivalent amounts of other sodium halide salts may be employed. Expressed another way, the preferred operating range for NaCl would be from about 0.01% to about 1.5% and more preferably from about 0.05% to about 1.0%, by weight of the anolyte solution.

The anolyte pH is maintained during the operation in the range from about 10 to greater than 14 and preferably at least about 14 because of the stability of the sodium ferrate product in any aqueous solution is extremely sensitive to the pH. With a pH below 10, the ferrate product may begin to decompose to liberate oxygen and form $Fe_2O_3$.

If the anode is made of iron-ferrous material, it is necessary that the anolyte contain a source of ferric ions from which the sodium ferrate may be produced. Ferric ion sources include ferric salts such as ferric chloride and ferric sulfate or sources of pure iron such as iron particles, iron scraps and the like. If such ferric ion sources are employed instead of or concurrently with an iron anode, their amounts used in the anolyte would mainly depend upon the final concentration of sodium ferrate desired in the product after electrolysis.

Generally, the range of ferric ion concentration in the anolyte is from about 0.001% to about 12% of the anolyte. The preferable concentration range of ferric ion is from about 0.1% to about 10% by weight. It should be noted that the ferric ion concentration may be less or greater than the above recited range during startup and shutdown of the cell; however, at equilibrium, the concentration is preferably within these ranges.

6. CATHOLYTE PARAMETERS

The catholyte of the present invention, like the anolyte, is maintained during operation as aqueous sodium hydroxide solution. Generally, the NaOH concentration may range from about 20% to about 65% by weight in the catholyte. Preferably, this NaOH concentration is from about 40% to about 65% by eight, and most preferably, from about 45% to about 65% by weight of the catholyte. However, unlike the anolyte, the catholyte may be initially charged with pure $H_2O$ before operation. Through the electrolysis operation, NaOH will be formed in the catholyte by the transport of $Na^+$ ions to the catholyte chamber and by their reaction therein with $OH^-$ ions. Water may be added to the catholyte during or after electrolysis to replenish the water consumed during the operation. Since the concentration of NaOH will be increasing in the catholyte, it may also be necessary to withdraw some concentrated NaOH solution in order to maintain the concentration of sodium hydroxide solution in the preferred range.

7. ELECTROLYSIS OPERATING PARAMETERS

The electrolysis step of this invention is performed by supplying a direct current to the cell and impressing a voltage across the cell terminals. Without being bound by any theory, it is believed that during the operation of this step, a direct current flows to activate an electrochemical charge transfer directly at the anode, thereby converting Fe(0) atoms to $Fe^{+3}$ ions. Then the $Fe^{+3}$ ions are converted to $FeO_4^{-2}$ ions by further electrochemical charge transfer. In the case where $Fe^{+3}$ ions are added to the anolyte in salt form, rather than employing a Fe(0) anode, these $Fe^{+3}$ are also converted to $FeO_4^{-2}$ ions by electrochemical charge transfer.

The operating range for the current density of a membrane-type cell is from about 0.01 to about 5.0 kiloamperes per square meter ($kA/m^2$), with current densities from about 0.01 to about 1.0 $kA/m^2$ being preferred. The cell potential can range from about 1.5 to about 10 volts, with the preferred range of cell voltage being from about 1.5 to about 4.0 volts. The most preferred ranges for these parameters are from about 1.5 to about 3.5 volts and from about 0.03 to about 0.5 $kA/m^2$.

With the anolyte being composed of an aqueous solution of sodium hydroxide and a sodium halide salt, the preferable anode to membrane gap distance is in the range from 0 to about 1 inch, and the preferable cathode to membrane gap distance is in the range from about 0 to about ½ inch. The current efficiency may be optimized by the employment of an anolyte pH of about 14. The pH may be adjusted by periodic addition of sodium hydroxide to the anolyte solution during electrolysis.

The operating temperature of a membrane cell is in the range from about 10° C. to about 80° C. with an operating temperature in the range of about 20° C. to about 60° C. and from about 35° C. to about 50° C. being most preferred for fastest reaction with minimum product degradation for highest yields.

The operating pressure of the cell is essentially atmospheric. However, sub- or superatmospheric pressure may be used, if desired.

Sodium ferrate may be made in concentrations in the aqueous sodium hydroxide solution which range from trace amounts of about 0.001% to about 1.4% by weight of the anolyte. However, at the higher concentrations, sodium ferrate might begin to precipitate or crystallize out of the anolyte solution and collect in the bottom of the anolyte chamber. The preferred sodium ferrate concentrations are generally in the range from about 0.1% to about 1.0% by weight of the anolyte.

It is not certain exactly how sodium ferrate is produced by the electrolysis process. However, without being bound by a theory, it is thought that the ferric ion source in either the iron anode or iron salt in the anolyte, or their combination, is converted by electrolysis, or by bulk reaction with $OH^-$ ions, respectively, into ferric oxy-hydroxide complexes [e.g., $Fe_xO_y.nH_2O$ where n is at least one]. These complexes are next converted electrochemically in the presence of the halide ion to ferrate ions, which combines with $Na^+$ ions to form sodium ferrate. This theory is illustrated by equations (1) and (2) wherein the ferric ion source is metallic Fe (such as iron anode) or ferric chloride (such as added to the anolyte) and chloride ion is also present:

$$Fe + 8OH^- \xrightarrow[e^-]{Cl^-} [Fe_xO_y.nH_2O] \xrightarrow{e^-,\ Cl^-} FeO_4^= + 4H_2O + 6e^- \quad (1)$$

on anode surface $$FeCl_3 + 8OH^- \xrightarrow{Cl^-} [Fe_xO_y.nH_2O] \xrightarrow{e^-,\ Cl^-} FeO_4^= + 4H_2O + 3e^- + 3Cl^- \quad (2)$$

in bulk solution, transported to the anode surface

The main advantages of the use of a membrane-type electrolysis cell are the greatly increased current efficiency and lower power consumption. This is due to the elimination of two effects:

(a) electrochemical reduction of the ferrate ion at the cathode; and (b) chemical reduction of the ferrate ion by molecular hydrogen made at the cathode as illustrated in equation (3):

$$2FeO_4^= + 5H_2 \rightarrow Fe_2O_3 + 5H_2O \quad (3)$$

Another advantage of the present invention is that the hydrogen gas discharged from the catholyte chamber is isolated from any oxygen gas produced in the anolyte chamber by the competing reaction of $H_2O$ electrolysis in the anolyte. Because of this separation of chambers, the danger of forming explosive mixtures of hydrogen and residual oxygen gas is thereby minimized. Thus, the process of this invention eliminates the need for an inert gas purge such as would be required in an undivided or diaphragm cell.

8. POTASSIUM FERRATE FORMATION

Potassium ferrate (i.e., $K_2FeO_4$) is produced by the reaction of a potassium compound (e.g., KOH) with the sodium ferrate/sodium hydroxide solution from the anolyte chamber.

In one preferred operation, the anolyte solution is removed from the anolyte chamber and transferred to a suitable chemical reactor. This operation may be accomplished on a continuous or batch basis. The reactor may be equipped with a stirrer or agitator to ensure a complete reaction.

In the preparation of potassium ferrate, any suitable potassium compound may be used to react with the sodium ferrate in the sodium hydroxide anolyte. Suitable inorganic compounds preferably include potassium hydroxide, potassium halides such as KCl and KBr, and potassium hypohalites such as KOCl and KOBr. The most preferred compound is potassium hydroxide.

If potassium halide or hypohalite salts are employed, it is preferred to use chlorine or bromine as the halogen, with chlorine being most preferred.

A major advantage of using potassium hydroxide is that no additional sodium hydroxide need be fed into the overall process. During this reaction, the hydroxide ions from the added potassium hydroxide are converted to sodium hydroxide. This is illustrated by chemical equations (4) to (8) wherein KOH is utilized:

In the Membrane Cell:

In The Anolyte Chamber $$Fe + 8NaOH \xrightarrow{-6e^-} Na_2FeO_4 + 6Na^+ 4H_2O \quad (4)$$

In the Catholyte Chamber $$6Na^+ + 6H_2O \xrightarrow{+6e^-} 6NaOH + 3H_2\uparrow \quad (5)$$

Sum of Reactions in the Cell $$Fe + 2NaOH + 2H_2O \longrightarrow Na_2FeO_4 + 3H_2\uparrow \quad (6)$$

In the $K_2FeO_4$ Reactor $$Na_2FeO_4 + 2KOH \longrightarrow K_2FeO_4 + 2NaOH \quad (7)$$

Sum of Reactions in Membrane Cell & $K_2FeO_4$ Reactor $$Fe + 2H_2O + 2KOH \longrightarrow K_2FeO_4 + 3H_2 \quad (8)$$

Thus, if the NaOH formed in the $K_2FeO_4$ reactor is recycled to the anolyte chamber, the overall process is balanced as to NaOH and little or no additional sodium hydroxide is needed. Furthermore, the use of potassium hydroxide in the potassium compound reactor is preferred because no additional salts (e.g., NaCl) need be recovered and disposed of. The creation of unwanted salt is illustrated by equation (9) which shows the chemistry of the overall process when potassium chloride is utilized instead of a potassium hydroxide:

$$Fe + 2NaOH + 2H_2O + 2KCl \longrightarrow K_2FeO_4 + 3H_2\uparrow + 2NaCl \quad (9)$$

Comparison of equations (8) and (9) shows that reaction (8) with KOH is clearly superior. The only raw materials required therein are iron, KOH, water and electricity, whereas reaction (9) requires additional NaOH and disposal of NaCl.

If KOH is employed as the potassium compound, it is generally preferred to use a molar ratio of it to the sodium ferrate in the anolyte in the range of from about 2:1 to about 100:1 to ensure complete conversion of the sodium ferrate to potassium ferrate. More preferably, this molar ratio is in the range of from about 2:1 to about 10:1. Most preferably, the molar ratio is from about 2:1 to about 4:1. However, if it is desired to only convert a portion of the sodium ferrate in the anolyte solution, it may be desirable to use molar ratios of $KOH:Na_2FeO_4$ of less than about 2:1. And, if the other potassium compounds are employed (e.g., KCl) generally the same molar ratios are employed.

Also, if the NaOH produced by the $K_2FeO_4$ formation is recycled back to the cell, it is desirable to prevent an undesirable accumulation of potassium ions in the electrolysis cell.

For the reaction of KOH with $Na_2FeO_4$ to occur promptly and without product degradation, it is generally preferred to employ reaction temperatures in the range from about 20° C. to about 60° C. Most preferably, temperatures in the range from about 30° C. to about 50° C. may be employed. Reaction times for reacting KOH with $Na_2FeO_4$ may preferably range from about 1 minute to about 300 minutes in a stirred reactor. More preferably, reaction times are from about 10 minutes to about 200 minutes. Of course, if other potassium compounds are used instead of KOH then the reaction temperatures and time may vary from these ranges.

The reaction preferably occurs at atmospheric pressure; although sub-atmospheric and super-atmospheric pressures may be utilized. Of course, it should be recognized that any of the above-noted reaction parameters, besides the reactants themselves, are subject to many factors and, thus, are not critical limitations of the present invention.

In another preferred operation, a potassium compound, preferably KOH, is directly added to the anolyte chamber of the membrane cell. The potassium compound will react with the sodium ferrate as it is produced in the anolyte. The reaction product, namely, potassium ferrate, will immediately precipitate and may be removed continuously, or periodically by conventional solid/liquid separation means.

In still another preferred embodiment, sodium ferrate may be first recovered in a solid form by removing the anolyte from the anolyte chamber, chilling the anolyte to a temperature of about 5° C. to about 18° C., filtering the precipitated solid sodium ferrate from the aqueous sodium hydroxide solution and then reacting the precipitate with a solution of a potassium compound to produce potassium ferrate.

9. RECOVERY OF POTASSIUM FERRATE

Upon the reaction of a potassium compound and $Na_2FeO_4$, solid potassium ferrate precipitates from the solution. The precipitated product may be separated from the sodium hydroxide solution by any suitable solid/liquid separation means. The separated solid product is then dried, preferably after a washing operation to dissolve and remove any sodium hydroxide still attached to the product. Dried potassium ferrate is a purple powder.

An alcohol extraction agent may be employed to wash and remove the water and at least a portion of the NaOH, KOH and halide salts from the precipitated and separated potassium ferrate product. This may be done in any conventional leaching extraction equipment. The alcohol, salt and water mixture may be then flash distilled to separate a substantially anhydrous alcohol vapor stream from an aqueous sodium hydroxide residue. The alcohol stream may be recycled back to the leaching step so that the amount of alcohol continuously added to the process may be minimized. Further, the aqueous residue may be utilized as makeup for the anolyte solution in the cell.

The preferred alcohols for extraction of sodium hydroxide and water from potassium ferrate are low-molecular weight secondary alcohols; specifically, isopropyl or sec-butyl alcohols, or mixtures thereof. Methanol and ethanol and other related primary alcohols are oxidized quickly at room temperature by sodium and potassium ferrate. Alcohols having higher molecular weights than the first-named alcohols have very low sodium hydroxide solubilities which make them poor extraction agents.

Continuous extraction may be carried out under vacuum to avoid filtration and air exposure. This will improve the storage stability of the potassium ferrate product.

If an alcohol is utilized to leach the separated solids, it is preferred that the weight ratio of alcohol, in the case of isopropyl alcohol, to the total separated solids is from about 1:1 to about 500:1. More preferably, this weight ratio is from about 2:1 to about 120:1. In general, the weight ratio of alcohol, in the case of isopropyl alcohol, to $K_2FeO_4$ in the solids is preferably about 10:1 to about 10,000:1. More preferably, this weight ratio ranges from about 100:1 to about 500:1. If other alcohols are used, generally the same ratios are employed.

It should be realized that these extraction weight ratios are based on single contact extractions with no extractant or raffinate recycle. Much less alcohol overall is used if the alcohol is separated from the caustic and water it has extracted and is then recycled back to recover more potassium material.

In a preferred operation, the slurry prepared in the potassium ferrate reactor is separated into solid and liquid phases in a settling tank. The liquid phase is then separated from the solid product by decanting or by a basket-type centrifugal filter. The separated liquid NaOH solution may be then recycled back to the electrolysis cell. Generally, this recycled NaOH solution contains not more than a few percentage of unreacted sodium ferrate.

The solid potassium ferrate product which contains some unreacted NaOH, unreacted potassium compound and water is then transferred to an extractor, most preferably, a continuous dispersed-solids leaching extractor. The extraction solvent is, most preferably, isopropyl alcohol because of the high solubility of water and NaOH in it. The extracted solid potassium ferrate is withdrawn from the leaching unit and is dried by low-temperature heating with vacuum or by filtration with ether to form a dry, stable product. The extractant solvent is sent to a flash column where the alcohol is distilled off and then returned to the leaching extractor. The resulting NaOH solution from this distillation is also returned to the electrolysis cell.

Besides the above-mentioned potassium ferrate recovery steps, persons skilled in this art will recognize other suitable processes for recovering the ferrate product from the NaOH solution. The present invention intends to encompass all such suitable recovery processes and is not to be limited to any particular sequence of steps or to a step.

10. OTHER PREFERRED EMBODIMENTS AND UTILITY

In another preferred operation, the cell contains means to recycle the sodium hydroxide solution used in the catholyte chamber to the anolyte chamber where it is employed as part of the anolyte.

As mentioned above, the anolyte, after removal from the cell, is treated to produce potassium ferrate from the sodium hydroxide solution and then the sodium hydroxide solution is recycled back to the anolyte chamber.

In a second preferred operation, both recycle streams of these preferred operations are combined together and recycled back to the anolyte chamber. Any conventional means for pumping and the like may be used for these recycle operations.

Another preferred embodiment is to pretreat any ferric salts used as the ferric ion source in the anolyte chamber in order to convert any ferrous ($Fe^{+2}$) impurities therein to ferric ($Fe^{+3}$) ions. Such pretreatment may be carried out by either heating the ferric salt themselves or the anolyte containing these to about 70° C. to about 100° C. for a short period of time (e.g., less than 60 minutes) before electrolysis begins. Other weak oxidation methods (e.g. oxygen or chlorine treatment) may also be used.

Still another preferred embodiment is to ensure that the anolyte is saturated with oxygen ($O_2$) during the electrolysis operation when an iron anode is employed. It is believed that this increases the sodium ferrate yield by destruction of any impurities present (e.g., $Fe^{+2}$ impurities in the anode) and increasing the number of ferric ions on the surface of the anode.

In another preferred operation, potassium ferrate is admixed with potassium hydroxide to enhance the stability of the product.

These and other embodiments of the present invention are illustrated by the following example. all parts and percentages are by weight unless explicitly stated otherwise.

EXAMPLE 1

Sodium ferrate solution was prepared batchwise in an electrolytic cell comprised of an anode, a cathode, an anolyte chamber, a catholyte chamber and an impermeable membrane separator positioned between the two electrodes and the two cell halves. The cell body was constructed of polytetrafluoroethylene and was 7.5 inches tall, 5.0 inches wide and 4.0 inches deep. The anolyte compartment had a volume of 550 mls and the catholyte compartment had a volume of 540 mls. The anolyte compartment was provided with a motor driven agitator. The anode to membrane gap was about ¼ inch and the cathode to membrane gap was about 1/16 inch.

The cell anode was a ¼ inch thick rectangular flat piece of #1014 mild steel plate of dimensions 5.1 cm wide by 7.0 cm high, which gave a front face active surface area of 35.7 $cm^2$. A ⅛ inch diameter steel wire was spot-welded to the back of the steel piece, and the steel wire, the back sides of the steel piece, were covered with epoxy and allowed to set thoroughly. This ensured that only the front face of the steel anode was active to electrochemical reaction.

The cell cathode was a piece of 0.03 cm thick nickel expanded mesh with ¼ by ⅛ inch diamond openings with dimensions of 5.1 cm wide by 7.0 cm high, connected to the power supply by a ⅛ inch diameter nickel wire.

A perfluorosulfonic acid resin membrane was used. The membrane was a homogeneous perfluorosulfonic acid resin membrane, 5 mils thick 1200 equivalent weight, laminated with T-12 fabric of polytetrafluoroethylene which is sold commercially by the DuPont Company as Nafion® 425 brand membrane. As used herein, it had an active area of the membrane during operation of 5.1 cm by 7.0 cm or 35.7 $cm^2$. Prior to use, it was soaked in 15 wt. % NaOH for 18 hours for conditioning.

The electrolyte for each run was prepared by admixing 1,000 mls of an aqueous 45 wt. % NaOH solution (diluted reagent grade) with 1.5 grams of reagent grade NaCl at room temperature for 15 minutes. The anolyte electrolyte was comprised of about 45 wt. % NaOH, 0.1 wt. % NaCl and the remainder being water. The catholyte electrolyte was a 50 wt. % NaOH solution.

About 430 mls of anolyte electrolyte was placed in the anolyte compartment and about 450 mls of catholyte electrolyte was placed in the catholyte compartment. The cell contained ¼ inch diameter cylindrical heater wells in both the anolyte and catholyte compartments. A tubular 200 watt heater was used in both compartments. The heaters were turned on and the temperature of the electrolyte was increased to about 55° C. and the heaters were then turned off.

The electric power was turned on to the cell at a current of 0.17 amps, which was equivalent to a true current density of 0.048 $kA/m^2$. Electrolysis was carried out with rapid anolyte stirring until the temperature reached 44° C. in the electrolyte. The following data was obtained:

| Time | Current | Voltage | Temperature |
|---|---|---|---|
| Power On, 0 minutes | 0.17 A | 2.34 V | 51° C. |
| Power Off, 65 Minutes | 0.17 A | 2.79 V | 44° C. |

The anolyte, which was a very dark purple, was removed from the cell. Its volume was 423 milliliters which weighed 603.6 grms. The anolyte cell liquor was titrimetrically analyzed by the chromite method, which showed it contained 0.1218 wt. % sodium ferrate ($Na_2FeO_4$). The current efficiency for the cell run was calculated to be 92.7% based on sodium ferrate produced.

At room temperature (26° C.), 3.5 liters of a combined solution containing 0.288 wt. % $Na_2FeO_4$ in 47% NaOH were placed into a 4-liter beaker and thoroughly mixed. The total amount of sodium ferrate in this material was about 15.12 grams of $Na_2FeO_4$. Under these stirred conditions, 4 separate batches of technical grade potassium hydroxide flakes were added gradually to keep the temperature of the mixture below 35° C., to exceed the saturation point and to obtain a maximum precipitation of potassium ferrate product. The following additions were performed:

| Batch | Batch Addition Starting Time | Amount of KOH Added | Temperature |
|---|---|---|---|
| 1 | 0 minutes | 52.5 g | 31° C. |
| 2 | 70 minutes | 50.0 g | 32° C. |
| 3 | 90 minutes | 50.0 g | 28° C. |
| 4 | 120 minutes | 52.0 g | 29° C. |

While it was estimated that about 250 grams of KOH would be required at 26° C. to reach saturation in the absence of the NaCl and $Na_2FeO_4$, it was found that after adding the above 204.5 grams of KOH, small, white insoluble fragments floated on the solution and the solution appeared saturated.

An apparatus was assembled which consisted of a 10-micron 500 ml glass frit vacuum filter fitted on top of a 4.0-liter Erlenmeyer vacuum flask, connected to a single-stage vacuum pump. At 27° C., about 1.0 liter of the solution containing the potassium ferrate suspended material was filtered through the glass filter under a vacuum of 25 inches of Hg. A very dark purple, stable potassium ferrate solid formed on the filter, along with a very clear, mostly ferrate-free NaOH filtrate. This filtrate analyzed to be about 0.001 wt. % $Na_2FeO_4$. Thus, about 96 wt. % of the sodium ferrate material reacted to form potassium ferrate, $K_2FeO_4$.

About 36.5 grams of a semi-dry potassium ferrate solid was recovered from the glass filter. This was placed in a 2.0-liter beaker and mixed thoroughly for 2.0 hours at room temperature in 1200 mls of isopropanol. The isopropanol-ferrate suspension was transferred again to a clean and dried glass vacuum filter and vacuum-filtered, leaving a finely dispersed alcohol-wet potassium ferrate solid on the filter. Under vacuum, 500 mls of diethyl ether was next pulled through the filter, after which the semi-dried material was transferred to a ceramic weighing dish in a vacuum dessicator and 25 inch Hg of vacuum was pulled for 8.0 hours. The final dry solid material weighed 29.6 grams and analyzed 8.33 wt. % $K_2FeO_4$ with the rest being NaOH, KOH and NaCl. This result represents an overall recovery efficiency of 57.2% recovery of solid $K_2FeO_4$ from the $Na_2FeO_4$ cell liquor.

EXAMPLE 2

The 8.33 wt. % potassium ferrate $K_2FeO_4$ sample produced in Example 1 was used to test the effectiveness of the $K_2FeO_4$ product in the removal or destruction of environmentally-harmful cyanide ion from municipal boiler or industrial waste-waters. A solution of 0.01 grams/liter sodium cyanide (10 ppm NaCN) was made up using reagent-grade sodium cyanide and deionized water. Two tests were run using 100 mls and 50 mls of this solution, respectively. At room temperature, excess amounts of the above-mentioned potassium ferrate solid were added (75 ppm and 167 ppm, respectively) to each solution, stirred and reacted for 10 minutes and then each sample analyzed by the standard American Public Health Association (APHA) pyridine-pyrazolone method for concentration of residual cyanide remaining after reaction with the ferrate. The following results were obtained:

| Amount of $CN^-$ | $K_2FeO_4$ Added | Resulting pH | Contact Time | Residual Cyanide | Destruct Ratio |
|---|---|---|---|---|---|
| 10 ppm $CN^-$ (in 100 ml) | 75 ppm | 11.2 | 10 min. | 0.082 ppm | 7.6:1 |
| 10 ppm $CN^-$ (in 50 ml) | 167 ppm | 11.6 | 10 min. | 0.062 ppm | 16.8:1 |

The destruct ratio is defined as milligrams of oxidant consumed per milligram of cyanide destroyed or removed.

The results show that cyanide anion can be very effectively removed and destroyed by treating wastewaters with the potassium ferrate solid produced in Example 1.

COMPARISON 1

An attempt was made to produce a sodium ferrate-containing anolyte under the same conditions as described in Example 1 except that a titanium mesh cathode and except that an anolyte solution which was substantially free of sodium chloride were used. The membrane was soaked for 18 hours in deionized water prior to insertion in the cell. The cell parts were thoroughly soaked in diluted sulfuric acid in deionized water for 1 hour, then rinsed thoroughly with deionized water before assembling the cell.

500 Mls of 50% NaOH which contained 50 ppm chloride was added to the catholyte chamber of the cell. 430 Mls of 42.6 wt. % NaOH containing 6.0 ppm chloride was added to the anolyte compartment of the cell.

At room temperature (about 25° C.), electric power was applied to the cell at a controlled current of 0.072 amps, equivalent to a true current density of 0.02 $kA/m^2$ at the anode. The electrolysis was continued for 2.0 hours at this current density during which the following data was obtained:

| Time | Current | Voltage | Temperature |
|---|---|---|---|
| Power On, 0 minutes | 0.072 amps | 2.12 V | 23° C. |
| 43 minutes | 0.071 amps | 2.13 V | |
| 60 minutes | 0.072 amps | 2.3 V | |
| Power Off, 2.0 hours | 0.072 amps | 2.45 V | 26° C. |

The anolyte was recovered as a volume of 430 mls weighing 606.12 grams. Analysis of the light purple anolyte by the chromite titrimetric method showed a concentration of 0.0003 wt. % $Na_2FeO_4$ which is just visible to the human eye. The current efficiency for the cell run was calculated to be 1.22% based on sodium ferrate.

The above comparison tests results, when compared to the results of Example 1, clearly show that membrane cell electrolytic production of sodium ferrate is greatly enhanced by the presence of a sodium halide salt for the efficient production of ferrate salts by the electrolytic method. Furthermore, the halide salts are helpful for stabilization of sodium ferrate solutions and solid sodium ferrate. Further benefits besides high product yields and cell efficiencies include inexpensive operating and recovery costs and stabilized cell operation.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A process for preparing potassium ferrate which comprises:

(a) admixing sodium hydroxide containing less than about 0.02% by weight of sodium halide with sufficient sodium halide to increase the sodium halide concentration of the resulting mixture to between about 0.02% and about 4.0% by weight;

(b) carrying out an electrolysis process with an anolyte comprising said resulting mixture and ferric ions whereby sodium ferrate is formed in the anolyte;

(c) reacting said sodium ferrate with a potassium compound capable of reacting with said anolyte to form a potassium ferrate precipitate; and (d) recovering said potassium ferrate therefrom.

2. The process of claim 1 wherein the source of said ferric ions is selected from the group consisting of ferric salts, iron particles, iron scraps, iron containing anode and mixtures thereof.

3. The process of claim 2 wherein the source of said ferric ions is an iron-containing anode.

4. The process of claim 1 wherein the sodium hydroxide concentration of said anolyte is from about 20% to about 65% by weight.

5. The process of claim 4 wherein the sodium hydroxide concentration of said anolyte is from about 40% to about 65% by weight.

6. The process of claim 1 wherein the catholyte of said electrolysis process has a sodium hydroxide concentration from about 20% to about 65% by weight.

7. The process of claim 6 wherein the catholyte of said electrolysis process has a sodium hydroxide concentration from about 45% to about 65% by weight.

8. The process of claim 1 wherein the percentage of sodium halide salt admixed in said mixture is from about 0.1% to about 2.0% by weight.

9. The process of claim 1 wherein said sodium halide salt is sodium chloride.

10. The process of claim 1 wherein the operating temperature of said electrolysis process is in the range from about 10° C. to about 80° C.

11. The process of claim 10 wherein the operating temperature of said electrolysis process is in the range from about 35° C. to about 50° C.

12. The process of claim 1 wherein the amount of sodium ferrate formed in step (b) is from about 0.001% to about 1.4% by weight of said anolyte.

13. The process of claim 12 wherein the amount of sodium ferrate formed in step (b) is from about 0.1% to about 1.0% by weight of said anolyte.

14. The process of claim 1 wherein said potassium compound is selected from the group consisting of potassium hydroxide, potassium halide and potassium hypohalites.

15. The process of claim 14 wherein said potassium compound is potassium hydroxide.

16. The process of claim 15 wherein the molar ratio of said KOH to $Na_2FeO_4$ in said anolyte is in the range from about 2:1 to about 100:1.

17. The process of claim 16 wherein the molar ratio of said KOH to $Na_2FeO_4$ in said anolyte is in the range from about 2:1 to about 4:1.

18. The process of claim 1 wherein said reaction step (c) is carried out at a temperature in the range from about 20° C. to about 60° C.

19. The process of claim 18 wherein said reaction step (c) is carried out at a temperature in the range from about 30° C. to about 50° C.

20. The process of claim 1 wherein said recovery step (d) comprises:

(i) separating said potassium ferrate precipitate from said anolyte;

(ii) extracting said separated potassium ferrate precipitate with a secondary alcohol;

and (iii) drying said extracted potassium ferrate precipitate.

21. The process of claim 20 wherein said secondary alcohol is isopropyl alcohol.

22. The process of claim 21 wherein the weight ratio of isopropyl alcohol to potassium ferrate ranges from about 10:1 to about 10,000:1.

23. The process of claim 22 wherein the weight ratio of isopropyl alcohol to potassium ferrate ranges from about 100:1 to about 500:1.

24. The process of claim 20 wherein said secondary alcohol is secondary butyl alcohol.

25. The process of claim 1 wherein said electrolysis is performed in a membrane cell.

26. The process of claim 25 wherein said membrane is a gas and liquid impermeable permselective cationic exchange membrane.

27. A process for producing potassium ferrate, utilizing an electrolytic cell having an anolyte chamber containing an anode, a catholyte chamber containing a cathode, and a gas and liquid impermeable permselective cationic exchange membrane between the chambers, the process comprising the steps of:

(a) admixing in the anolyte chamber an anolyte comprised of from about 20% to about 65% by weight of NaOH containing less than about 0.02% by weight NaCl with sufficient NaCl to increase the NaCl concentration in the resulting mixture to between about 0.02% to about 4.0% of the total weight of NaOH and NaCl in said anolyte, said anolyte additionally containing ferric ion;

(b) maintaining as the catholyte an aqueous solution comprising from about 20% to about 65% by weight of NaOH;

(c) passing an electric current and impressing a voltage between said anode and said cathode at a temperature from about 10° C. to about 80° C. whereby sodium ferrate is formed from said ferric ions in the anolyte in an amount equal to between about 0.001% to about 1.4% of the weight of said anolyte;

(d) reacting said sodium ferrate while in said anolyte with potassium hydroxide in a molar ratio of said KOH to $Na_2FeO_4$ of between about 2:1 to about 100:1 to form a potassium ferrate precipitate from said anolyte;

(e) separating said potassium ferrate precipitate from said anolyte;

(f) extracting said potassium ferrate precipitate with isopropyl alcohol in an amount equal to a weight ratio with said potassium ferrate in the range of about 10:1 to about 10,000:1; and (g) drying said extracted potassium ferrate precipitate whereby a dry, stable product is produced.

28. A process for producing potassium ferrate, utilizing an electrolytic cell having an anolyte chamber containing an anode, a catholyte chamber containing a cathode, and a gas and liquid impermeable membrane between the chambers, the process comprising the steps of:

(a) admixing in the anolyte chamber an anolyte comprised of from about 40% to about 65% by weight of NaOH containing less than about 0.02% by weight NaCl with sufficient NaCl to increase the NaCl concentration in the resulting mixture to between about 0.1% to about 2.0% of the total weight of NaOH and NaCl in said anolyte, said anolyte additionally containing ferric ion;

(b) maintaining as the catholyte an aqueous solution comprising from about 45% to about 65% by weight of NaOH;

(c) passing an electric current and impressing a voltage between said anode and said cathode at a temperature from about 35° C. to about 50° C. whereby sodium ferrate is formed from said ferric ions in said anolyte in an amount equal to between about 0.1% to about 1.0% of the weight of said anolyte;

(d) reacting said sodium ferrate while in said anolyte with potassium hydroxide in a molar ratio of said KOH to $Na_2FeO_4$ of between about 2:1 to about 4:1 to form a potassium ferrate precipitate from said anolyte;

(e) separating said potassium ferrate precipitate from said anolyte;

(f) extracting said separated potassium ferrate precipitate with isopropyl alcohol in an amount equal to a weight ratio with said potassium ferrate in the range of about 100:1 to about 500:1; and (g) drying said extracted potassium ferrate precipitate with ether whereby a dry, stable product is produced.

* * * * *

UNITED STATES PATENT AND TRADEMARK OFFICE

CERTIFICATE OF CORRECTION

PATENT NO. : 4,435,256

DATED : March 6, 1984

INVENTOR(S) : J. Paul Deininger and Ronald L. Dotson

It is certified that error appears in the above-identified patent and that said Letters Patent is hereby corrected as shown below:

On the Title Page under "United States Patent [19]" after "Deininger" please insert --et al.--.

On the Title Page after "[54] Process For Making Potassium Ferrate" please delete "(Fe(VI))" and insert --[FE(VI)]--.

On the Title Page after "[75]" delete "Inventor: J. Paul Deininger, Cleveland, Tenn." and insert --Inventors: J. Paul Deininger; Ronald L. Dotson; both of Cleveland, Tenn.--.

On the Title Page under "Other Publications [56]" please delete "Andett. et al., Inorganic Chemistry, vol. 11, No. 8, pp. 1904-1908, (1972)" and insert --Audette et al., Inorganic Chemistry, vol. 11, No. 8, pp. 1904-1908, (1972).--.

In Column 1, at line 7, after "March 23 , 1981" please delete "." and insert --, now abandoned.--.

UNITED STATES PATENT AND TRADEMARK OFFICE

CERTIFICATE OF CORRECTION

PATENT NO. : 4,435,256

DATED : March 6, 1984

INVENTOR(S) : J. Paul Deininger and Ronald L. Dotson

It is certified that error appears in the above-identified patent and that said Letters Patent is hereby corrected as shown below:

In Column 1, at line 9, after "March 23, 1981." please delete "." and insert -- , now abandoned.--.

In Column 1, at line 33, please delete "lask" and insert --lack--.

In Column 1, at line 55, please delete "at" and insert --a--.

In Column 5, at line 50, please delete "iron-ferrous" and insert --non-ferrous--.

In Column 8, at line 16, Equation 4, after "$6Na^+$" and before "$4H_2O$" please insert --+--.

In Column 11, at line 27, please delete "all" and insert --All--.

Signed and Sealed this

*Fifth* Day of *February 1985*

[SEAL]

*Attest:*

DONALD J. QUIGG

*Attesting Officer*

*Acting Commissioner of Patents and Trademarks*